United States Patent [19]

Bayless

[11] Patent Number: 4,949,688

[45] Date of Patent: Aug. 21, 1990

[54] ROTARY INTERNAL COMBUSTION ENGINE

[76] Inventor: Jack H. Bayless, 14335 Chadbourne, Houston, Tex. 77079

[21] Appl. No.: 302,580

[22] Filed: Jan. 27, 1989

[51] Int. Cl.[5] ..... F02B 53/00

[52] U.S. Cl. ..... 123/245; 123/202; 418/35

[58] Field of Search ..... 123/245; 418/33, 35

[56] References Cited

U.S. PATENT DOCUMENTS 2,253,445 8/1941 Shufeldt ..... 418/35 X
3,899,269 8/1975 Diamond ..... 418/35

FOREIGN PATENT DOCUMENTS 110806 5/1964 Czechoslovakia ..... 418/35

*Primary Examiner*—Michael Koczo
*Attorney, Agent, or Firm*—R. L. Graham

[57] ABSTRACT

An internal combustion engine rotary engine includes four pistons mounted for rotary movement in an annular piston chamber, a drive shaft disposed at an angle of 30° to 80° relative to the piston axis of rotation, and two drive rod assemblies interconnecting the pistons in paired relationship. A connecting rod of each assembly extends through the shaft and each is drivingly coupled thereto.

10 Claims, 5 Drawing Sheets

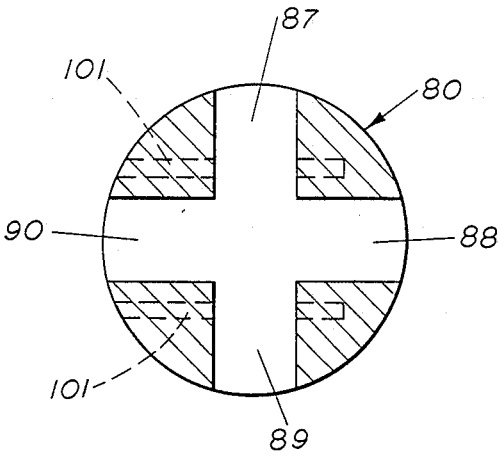
FIG. 5
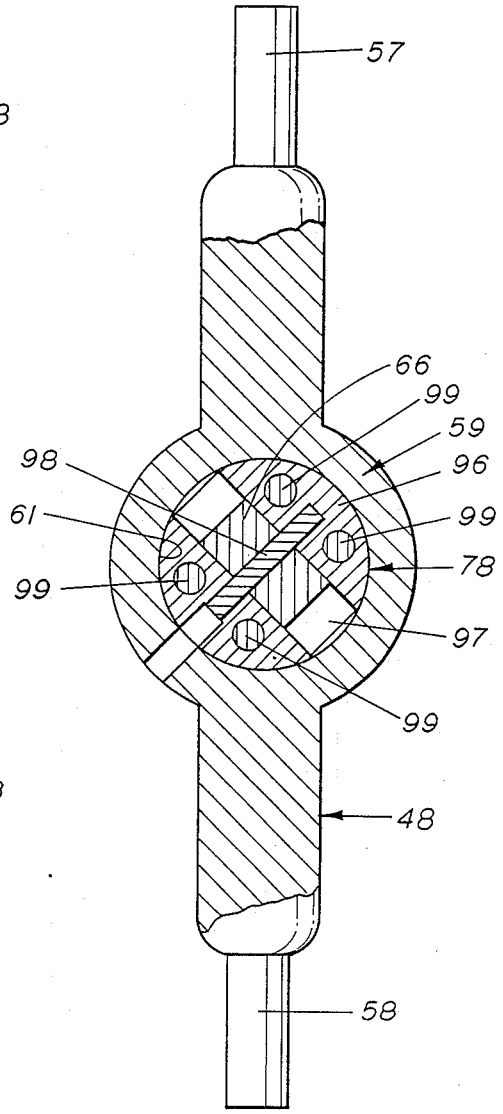
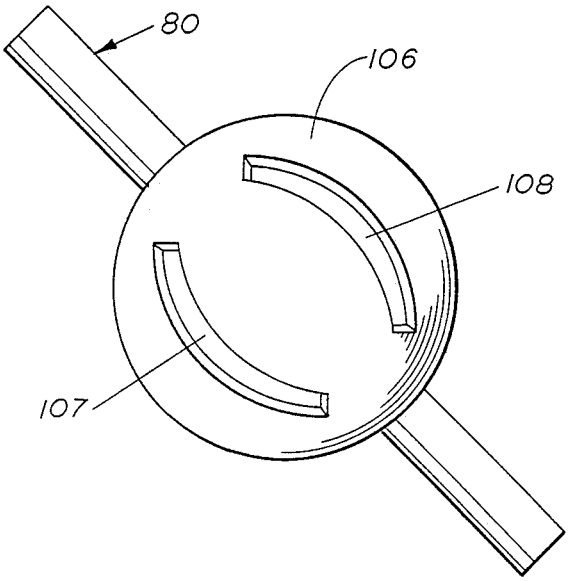
FIG. 7
FIG. 6

ROTARY INTERNAL COMBUSTION ENGINE

BACKGROUND OF THE INVENTION

The present engine relates to an internal combustion rotary engine. In one aspect, the invention relates to a rotary engine having a novel shaft-piston arrangement.

Many attempts have been made to develop rotary engines in the past because of the inherent simplicity of direct conversion of mechanical power into rotary motion, i.e. turbine-like devices. All of the previous designs have serious operational flaws. One such engine, disclosed in U.S. Pat. No. 3,302,625, is controlled by elliptical-eccentric gears. However, such gears have limited power output and are relatively expensive to manufacture. Other designs of rotary engines are disclosed in U.S. Pat. No. 1,676,211 (cranking shaft-gear arrangement), U.S. Pat. No. 2,126,795 (gear-cam arrangement) and U.S. Pat. No. 1,950,228 (cam arrangement). These designs are quite complex and generally too expensive for widespread use.

SUMMARY OF THE INVENTION

The rotary engine of the present invention features a novel construction that is not only simple in design but results in effective conversion of heat energy to mechanical energy.

A novel feature of the invention resides in the angular disposition of rotary engine shaft and the orbiting pistons. Unlike conventional rotary engines, the drive shaft and the piston axis of rotation of the present invention are disposed at an angle of 30° to 80°, preferably 45° to 75°, and most preferable, 55° to 70°. The drive shaft axis and the axis of the piston rotation are in a plane which passes through or proximate the engine combustion chamber.

Briefly, the rotary engine of the present invention comprises an annular piston chamber, four pistons mounted in the chamber for circular rotation about an axis, a drive shaft having four parallel and longitudinal slots formed therein, and connector means drivingly interconnecting the pistons and the shaft.

Two sets of pistons are drivingly connected to the shaft in paired relationship so that ignition drives one of the paired pistons in a power stroke and the other piston in a compression stroke.

In one rotary cycle each piston moves through an intake compression stroke and an expansion power stroke. Ignition occurs at the end of the compression stroke with the piston positioned near the shortest distance from the drive shaft.

BRIEF DESCRIPTION OF THE DRAWINGS

FIG. 5 is a cross sectional view of the drive shaft of the engine taken along the cutting plane taken through the geometric center of the drive shaft (shown in the disassembled condition).

FIG. 6 is an enlarged view of the bearing assembly shown in FIG. 1.

FIG. 7 is a side elevation of another embodiment of a shaft useable in the engine of the present invention.

DESCRIPTION OF THE PREFERRED EMBODIMENTS

The engine constructed according to the present invention is made of three main assemblies: a housing assembly; a piston assembly; and a drive shaft assembly.

Housing Assembly

Figure 1:
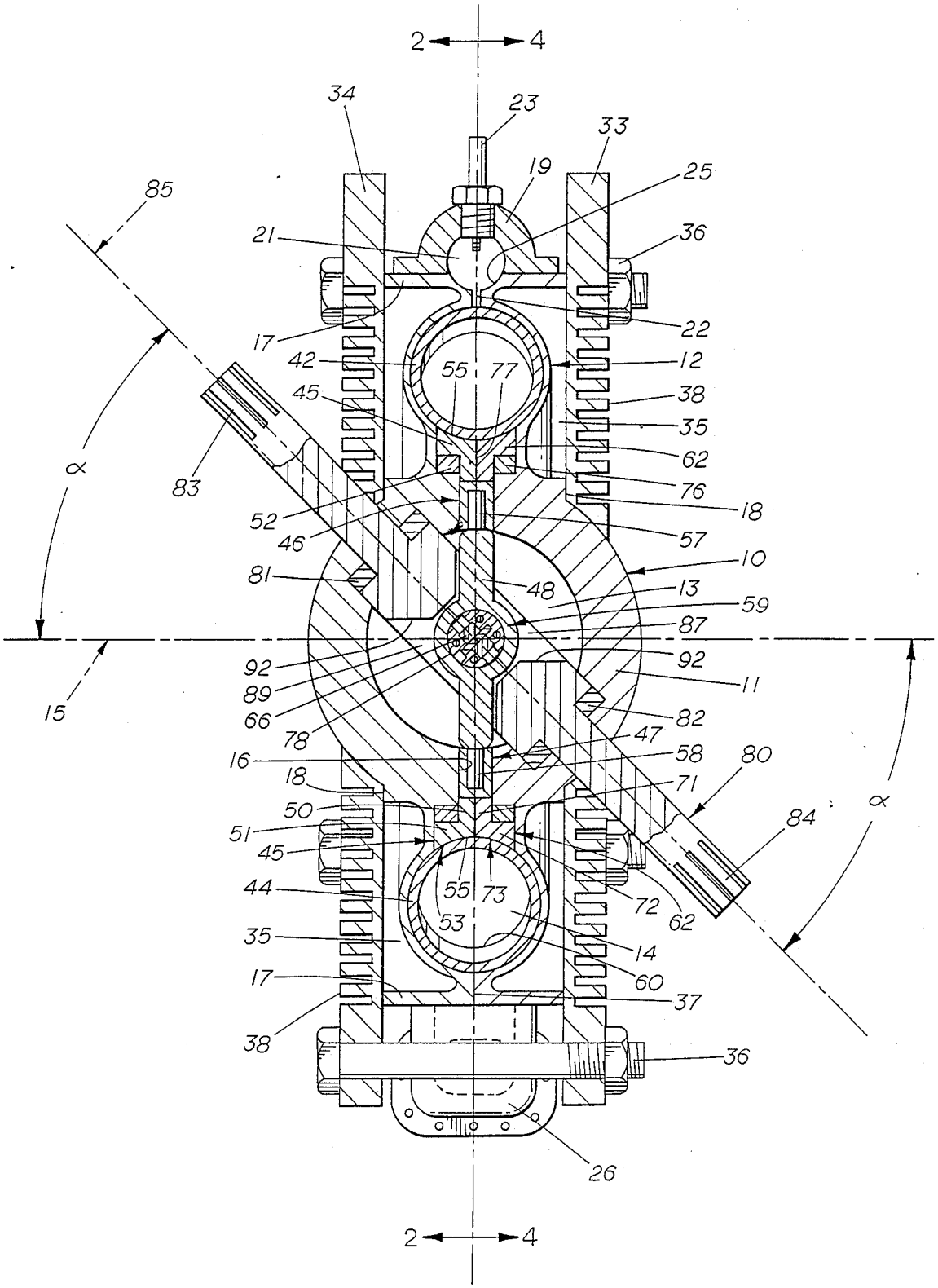
FIG. 1 is a schematic, shown in the vertical section, of a rotating internal combustion engine constructed according to the present invention, with the cutting plane taken along the axis of the drive shaft and axis of rotation of the pistons.

Referring to FIG. 1 the housing assembly comprises a housing 10 having a generally spherical main body 11, and a casing section 12 which encircles the main body 11. The interior of main body 11 may be hollow as illustrated at 13 and the casing section 12 defines an annular piston chamber 14. The chamber 14 may be considered a toroid generated by a circle rotated about an axis as at 15. For description purposes of the present invention, spacial relationship of the housing and piston assembly parts will be referred to as "axial", "radial", or "circumferential" with respect to axis 15. As will be described later, axis 15 is also the axis of rotation of the engine pistons.

A circular and continuous slot 16 is formed in the housing between body 11 and casing 12, providing an annular opening between interior 13 of body 11 and annular chamber 14.

Circular axially extending flanges 17 formed at the outer periphery of the housing 10, completely encircle casing 12. Formed in the outer periphery of the body 11 are two circular shoulders 18, which are aligned with the outer ends of the flanges 17 and provide mounting flange contact surfaces as described below.

Figure 2:
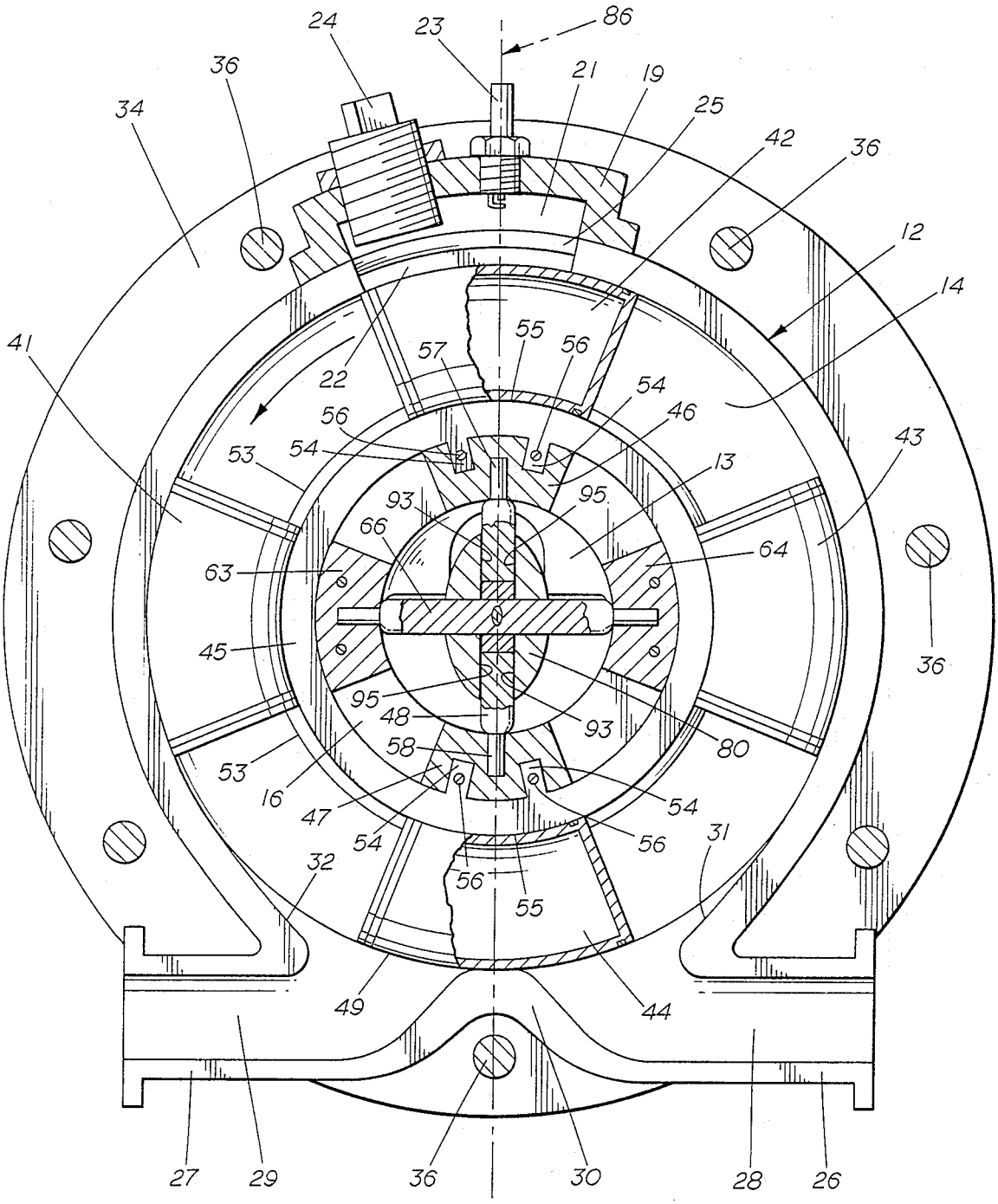
FIG. 2 is a sectional view of the engine taken generally along the cutting plane 2—2 of FIG. 1.

In a preferred embodiment, the engine combustion chamber is external of the piston chamber 14. As shown in FIGS. 1 and 2, a cover member 19, semi-circular in cross section and having its ends closed, is secured to the outer face of flanges 17. Member 19 defines a combustion chamber 21. A portion of the outer periphery of the casing may be recessed as at 25. Recess 25 and member 19 define a generally cylindrical combustion chamber 21. A slot 22 formed in the outer edge of casing 12 provides fluid communication between piston chamber 14 and combustion chamber 21. A spark plug 23 and, optionally, a volume control plug 24 are threadedly connected to the semi-circular member 19.

As best seen in FIG. 2, casing 12 is provided with connectors 26 and 27 which provide an inlet 28 an a outlet 29, respectively, for engine fuel (e.g. mixture of air, lubricant, and fuel) for piston chamber 14. The inlet and outlets 28, 29 are separated by short wall 30 of casing 12. Wall section 30 is located approximately opposite the combustion chamber 21. Immediately downstream (i.e. direction of fuel mixture flow) of inlet connector 26, the interior of outer wall of casing 12 is tapered as at 31; and immediately upstream of outlet connector 27, the interior of outer wall of casing 12 is tapered as at 32.

In the preferred embodiment, the continuous piston chamber 14 is circular in cross section and is completely enclosed except for slots 16, 22, openings 28 and 29 and tapered portions 31 and 32.

The shape of the slot 16 is sized to receive the parts of the piston assembly as described in detail below.

The housing 10 may be cast, manufactured, or forged from steel, aluminum, or suitable alloys, and machined for proper fit. The housing 10 may be formed in mirror-image halves (except for the drive shaft holes) and assembled by mounting flanges 33 and 34. Flanges 33 and 34 engage opposite sides of the housing 10 on outer edges of spacer flange 17 and shoulders 18. Bolts 36 circumferentially spaced about the flanges 33 and 34 maintain the parts in assembled condition. The housing halves may be unitary or formed in separate parts and joined together as by welding.

The engagement of confronting circumferential surfaces as at 37 of the outer wall of casing 12 halves provides the proper spacing for slot 16. Surface engagements 37 is continuous except for slot 22, openings 28 and 29 and tapered portions 31 and 32.

The flanges 33 and 34 may be provided with cooling fins 38. A cooling medium may be circulated in space 35.

Piston Assembly

Four hollow pistons 41, 42, 43, and 44 are mounted for orbital movement through piston chamber 14. The pistons are generally of the same cross section of chamber 14 and may be provided with piston rings (as illustrated). The cylindrical outer surface of each piston (as shown at 49 in FIG. 2) is curved to conform to the curvature of the chamber 14. The construction and dimensions of the pistons in relation to the chambers 14 may be in accordance with well recognized principles of rotary engines.

In FIG. 1, the intersection 60 of the end wall of the piston 44 and the interior side wall of the piston can be seen.

The four pistons 41–44 are movable through the piston chamber in paired relation, piston 41 being paired with piston 43, and piston 42 with piston 44 through separate but cooperative connecting means.

The means for interconnecting the pistons in the paired relation may take a variety of forms. The embodiment described herein are but one of such forms.

Considering first piston pair 42 and 44 (shown in FIGS. 1 and 2), the connecting means comprises a circular ring 45, connectors 46 and 47, and a connector rod 48.

The ring 45 is movably mounted in approximately one-half of slot 16 as viewed in FIG. 1 and includes a radial portion 50 and an axial portion 51 best seen in FIG. 1. A circular bearing 52 is mounted between ring 45 and the housing 11. The radial outer surface 53 of ring 45 is curved to conform to the surface of chamber 14. Pistons 42 and 44 are secured as by welding at 55 to surface 53 of ring 45. The inner edge of ring 45 is provided with two pairs of diametrically positioned, inwardly extending tabs 54 (shown in FIG. 2). The connectors 46 and 47, are secured to the ring 45 by the tabs 54 and fasteners (e.g. pins 56) and are moveable within slot 16 (see FIG. 1). The sides of the connectors 46 and 47 receive the tabs 54 and pins 56 in countersinks so that the connector sides confront the walls defining slot 16 in close clearance but sliding relationship. The connectors 46 and 47 may be made of bearing material such as bronze, or other suitable alloys.

The connector rod 48 extends through hollow interior 13. Its opposite ends are provided with pins 57 and 58. The pins 57 and 58 fit into complementary shaped holes in the connectors 46 and 47, respectively. Pins 57 and 58 permit pivotal movement of rod 48 relative to connectors 46 and 47 as pistons 42 and 44 orbit in chamber 14.

The connectors 46 and 47, which may be made of bearing material, are sized to fit within section of slot 16 as best seen in FIG. 1 and have generally the same curvature of ring 45 as best seen in FIG. 2. The ends of the rod 48 from which the pins 57 and 58 project are rounded to permit pivotal movement of rod 48 relative to connector 47. The connectors 46 and 47 move in close conformity within slot 16.

Formed in the center of rod 48 is a ring section 59 having a hole 61 (see FIG. 6) formed therein, in which, as described below, is mounted a bearing for interconnecting the connecting rods and the drive shaft.

Figure 4:
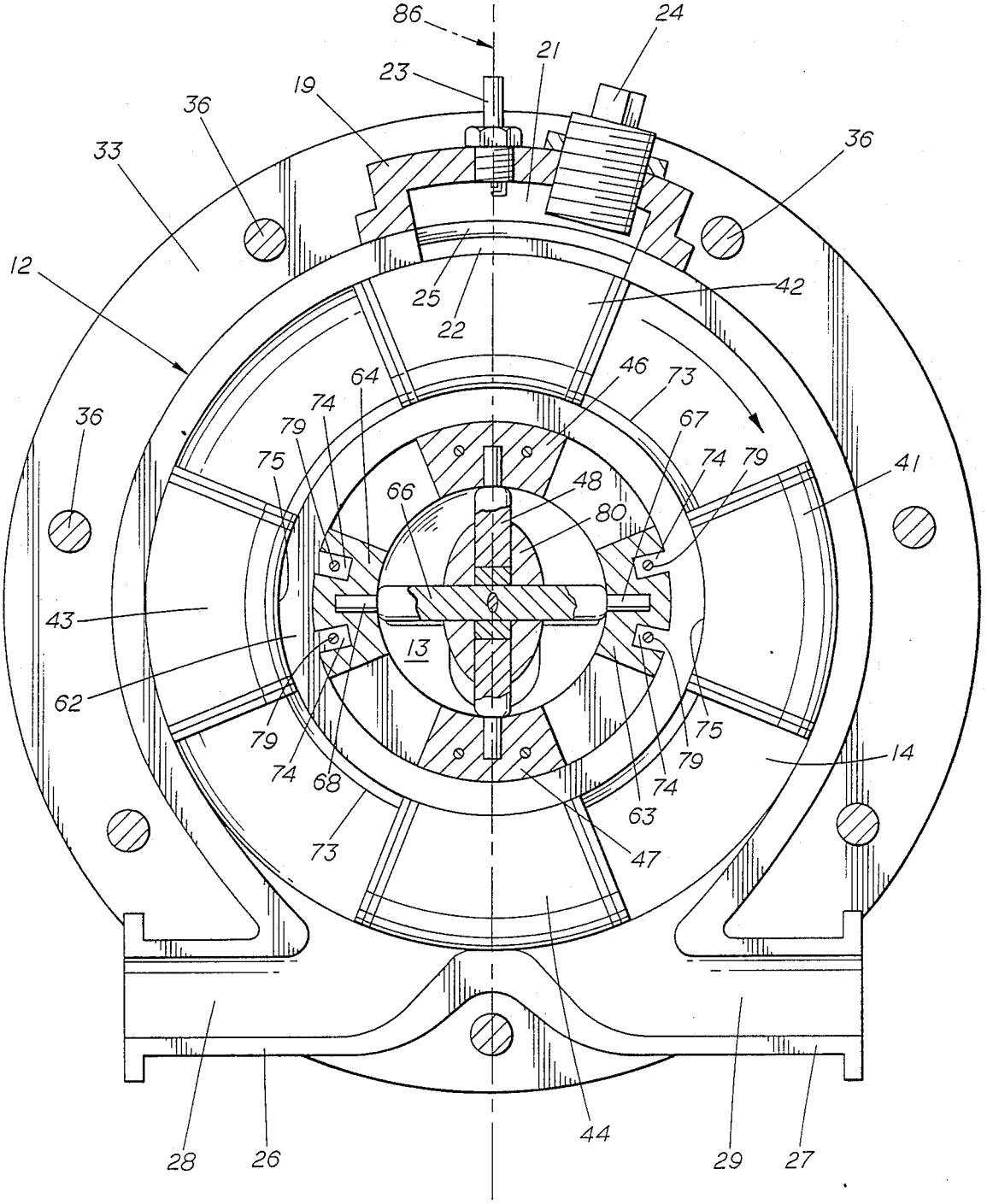
FIG. 4 is a sectional view of the engine taken generally along cutting plane 4—4 of FIG. 1.

As shown in FIG. 4, the second pair of pistons 41 and 43 are similarly interconnected, the connector means comprising ring 62, connectors 63 and 64, and connector rod 66. Rod 66 has pins 67 and 68 formed in its opposite ends which fit in complementary shaped holes in connectors 63 and 64.

The ring 62 fits within slot 16 in side-by-side and sliding relationship to ring 45 as best seen in FIG. 1. Ring 62 has a radial portion 71 and an axially extending portion 72 which extends in a direction opposite portion 51 of ring 45. The outer surface 73 of ring 62 is curved, having a curvature the same as chamber 14. Pistons 41 and 43 are welded to surface 73 as at 75 (FIG. 4). Diametrically positioned tabs 74 extending radially inwardly from ring 62 are secured to connectors 63 and 64 by fasteners (e.g. pins 79). Returning to FIG. 1, a circular bearing 76 is mounted between ring 62 and housing 11. The center of rod 66 passes through the center ring 59 of rod 48.

The piston pairs and associated connecting means are movable relative to each other, with piston pairs orbital as a unit within chamber 14 and rings 45 and 62 rotating in slot 16. Thus, piston pair 42–44, ring 45, connectors 46 and 47, and rod 48 are rotatable as a unit. Likewise, piston pair 41–43, ring 62, connectors 63 and 64, and rod 66 are rotatable as a unit. Each piston assembly is independently rotated about axis of rotation 15. Ring 45 is not connected to pistons 41 and 43 and their associated connectors 63 and 64; and ring 62 is not connected to pistons 42 and 44 and their associated connectors 46 and 47. The interface between rings 45 and 62, indicated by reference numeral 77 in FIG. 1, is a slideable bearing surface. Seals may be supplied on the rings 45 and 62.

The chamber 14 is a continuous circle defined by casing 12 and ring curved surfaces 53 and 73.

The rods 48 and 66 pivot relative to one another at their centers and need not be interconnected. Preferably, however, a bearing 78 (described in detail below) is employed between center ring 59 of rod 48 and a central portion of rod 66 shown generally in FIG. 1 and in more detail in FIG. 6.

Shaft Assembly

As shown in FIG. 1, a drive shaft 80 is journaled to housing body 11 by bearings 81 and 82. The outer ends of shaft 80 may be splined as at 83 and 84 for connection to a drive assembly. The shaft 80 is positioned in relation to the piston assembly so that (a) its axis 85 forms an angle $\alpha$ with the axis of rotation 15 and (b) the plane containing these axes passes through, or proximate, the combustion chamber 21. This imaginary plane is illustrated in FIG. 2 by reference numeral 86. Preferably, the plane 86 passes within 5° of the center of the combustion chamber 21, based on the axis of piston rotation 15. The shaft axis 85 intersects axis 15 at or near the geometric center of hole 61 formed in rod 48.

While the angle α may vary with relatively wide ranges, the preferred values of are as follows:

| | |
|---|---|
| 30–80° | broad range |
| 40–70° | preferred range |
| 45–65° | preferred range |
| 50–65° | most preferred range |

The central portion of the shaft 80 extending through interior 13 of body 11 is enlarged and is provided with four slots 87, 88, 89, and 90, circumferentiality spaced thereabout 90° apart, as shown in FIG. 5. The slots 87–89 extend longitudinally along the shaft 80 and arranged in paired relation: slot 87 being aligned with slot 89 and slot 88 with slot 90. Slots 87 and 89 thus form a passage through shaft 80 for receiving rod 48. The edges 92 of the slots may taper inwardly to permit pivotal movement of rod 48 therein (see FIG. 1) yet maintain maximum shaft strength. Likewise, aligned slots 88 and 90 receive rod 66. Slots 88 and 90 are also tapered inwardly to permit pivotal movement of rod 66 longitudinally along shaft 80.

The width of each of the four slots 87–90 preferably is sized in relation to the widths of the connecting rods 48 and 66 to provide contact surfaces and yet permit longitudinal movement of the rod within its associated slot. In one embodiment, the rods 48 and 66 may be rectangular in cross section with the larger side providing the sliding contact surfaces with shaft 80 within its associated slot.

As shown in FIG. 2, the leading side of each rod (e.g. 93 of rod 48) engages a side surface of its slot (e.g. 87 and slot 89) and transmits torque thereto in a power stroke. Contact surfaces (e.g. 95 of rod 48) on the trailing side of the rods 48 and 66 provide means for driving the rods and pistons in the compression stroke of the cycle. As indicated above, these contact surfaces preferably are flat.

In a preferred embodiment, a bearing assembly 78 is provided at the center of slots 87 and 89 to interconnect the rods 48, 66, and shaft 80. The bearing assembly 78, shown in FIG. 6 comprises a relatively flat cylindrical body 96, having a rectangular hole 97 extended axially therethrough and a pin 98 traversing a center portion hole 97. The pin 98 is mounted in suitable holes formed in bearing body 96.

The bearing 78 is secured to shaft 80 within slots 87 and 89. This may be achieved by fasteners such as set screws 99 which threadedly connect bearing body 96 to a side wall at the center of aligned slots 87 and 89. FIG. 5 illustrates threaded holes 101 for receiving fasteners 99. The bearing 78 mounted within center ring 59 of rod 48 may be inserted into the shaft 80 and fasteners 99 applied. With the bearing 78 and rod 48 in place, the rod 66 is then inserted through slots 88, and 90. The pin 98 may then be inserted through a suitable hole formed in ring 59 and rod 66. In the assembled condition, rod 48 pivots about the outer periphery of bearing 78 and rod 66 pivots about pin 98. Note that the rods 48 and 66 remain in their associated shaft slots.

Operation

The engine may be assembled by first installing ring 62 and associated pistons; then the rods 48 and 66 and bearing 78 on shaft 80 on one half of the housing 10 (with the split halves separated). The connectors 46,47,63, and 64 are then mounted on the end of the rods 48 and 66 and positioned on the housing. The connectors may then be secured to the rings 45 and 62 which are secured to the pistons. The other half of the housing 10 may then be installed and assembled by bolting together mounting flanges 33 and 34. The order of installation described above is only for purposes of illustration. One skilled in the art would have no difficulty in assembling the engine. It is of course understood, that minor modifications, such as access spaces and holes may be necessary to permit the assemblage.

Figure 3:
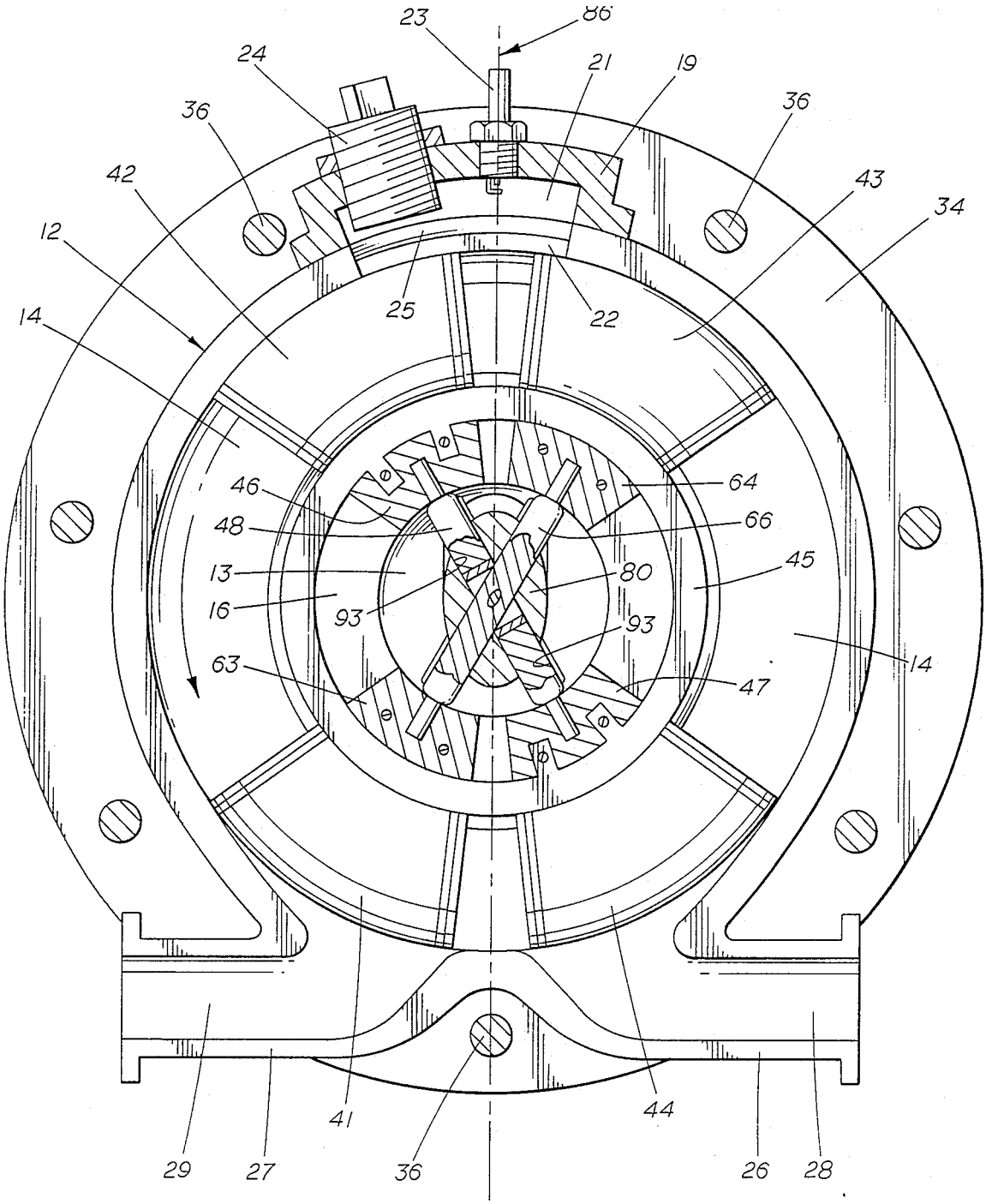
FIG. 3 is a view similar to FIG. 2 showing a different position of the engine pistons.

With the engine assembled, the engine is started by cranking the shaft 80, which rotates the pistons counterclockwise as viewed in FIGS. 2 and 3. Fuel mixture is sucked into chamber 14 through inlet 28, as for example between pistons 42 and 43 in FIG. 2. The fuel mixture is compressed to maximum pressure between pistons 42 and 43 opposite the combustion chamber 21 (FIG. 3 position). Ignition of spark plug 23 through conventional timing means (not shown) at this point drives piston 42 through a power stroke causing piston 42 to move toward piston 41. Force delivered to piston 42 by the expanding gases (caused by combustion) is transmitted to shaft 80 by engagement of rod 48 on slot wall 93. If bearing 78 is employed, the torque may also be transmitted, in part at least, to the shaft 80 through the bearing connection. As piston 42 is driven through a power stroke, this same force cause shaft 80 to drive rod 66 and pistons 41 and 43 a small distance relative to the distance of pistons 42 and 44 in the power stroke. Because of the geometry, piston 42 moves to the position of piston 41 in FIG. 3 while piston 44 moves to the position of piston 43 in FIG. 3 while piston 43 moves to the position of piston 42, and piston 41 moves to the position of 44.

In the next ignition, piston 43 is driven through an power stroke, forcing combustion products out outlet 29 ahead of piston 43.

The shaft 80 is thus rotated about its axis 85 and the pistons orbit about axis 15 within chamber 14. Each rod 48 and 66 pivots at its center point longitudinally within its associated shaft slot. For example, the upper part of rod 48 of FIG. 1 is in the left extreme position of slot 87 with piston 42 at or near the combustion chamber 21. However, 180° movement of piston 42 places the rod 48 in the right extreme position of slot 87 now also rotated 180°. For movement between the upper and lower positions, the upper half of rod 48, moves longitudinally along shaft 80 within slot 87.

An important feature of the invention is the angular arrangement of the shaft 80 and rotational axis 15. Ignition occurs with a piston near the minimum distance from the shaft 80. This can best be perceived with reference to FIG. 2. By tilting FIG. 2 about a horizontal axis until the oval (shaft 80) appears as a circle, (i.e. the perspective as viewed from end of shaft 80), rod 48 appears to be much shorter than rod 66. Rod 66 appears in its full length in this perspective, but rod 48 is tilted, the top portion away from the viewer and the bottom portion toward the viewer. The upper end of rod 48 thus is much closer to the shaft 80 than the ends of rod 66. This geometric arrangement of the shaft and rotational axis of the pistons results in several advantages. The pistons may be rotated cyclically without the need of special gears. Mechanical advantage results from utilizing a piston at its maximum moment arm compared to a piston at its minimum moment arm. Also, the geometric arrangement results in a mechanical advantage similar to the inclined plane. These mechanical advantage and momentum causes the piston to rotate counterclockwise (as viewed in FIG. 2) even though the combustion force is exerted on each piston defining the combustion chamber is the same.

It should be noted that while an external combustion chamber 21 is preferred, it need not be as large as illustrated. A large portion of the combustion chamber could be provided by the chamber 14 space between the pistons at the end of the compression stroke (FIG. 3 position of pistons 43 and 43), leaving a recess for the spark plug 23.

Alternative Embodiments

It will be appreciated by those skilled in the art that other arrangements are possible without departing from the scope and spirit of the present invention, i.e. particularly the angular relationship of the axis of shaft 80 and piston rotational axis 15.

The enlarged portion of shaft 80 within interior 13 of body 11 may be square or polygonal in cross section. Moreover, the shaft within interior 13 of body 11 may be spherical as illustrated in FIG. 7.

In this embodiment a hollow spherical section 106 is sized to fit snugly within interior 13 of housing body 11. Four slots, two illustrated as 107 and 108 are formed in section 106, 90° apart. Slots 107 and 108 are each paired and aligned with identical slots on the opposite side of section 106. The longitudinal centerlines of the aligned slots fall in the same plane as the shaft axis. Connecting means including connectors mounted for movement within the slots would interconnect pistons forming pairs much in the manner described previously, except no connecting rods would be required. The pistons would operate in paired relation as described previously with section 106 rotating within interior 13 of housing body 11. The connectors engaging side walls of the slots in section 106 would transmit torque to the shaft since section 106 is a part of the shaft.

Connecting rods while not necessary, may be used for increased stability.

It will be apparent to those skilled in the art that other geometric forms that describe a sphere upon rotating may be utilized instead of an actual sphere, and that edges rather than slots may be utilized to control movement of the pistons. Slot forms other than straight slot forms may also be utilized.

What is claimed is:

1. An internal combustion rotary engine comprising:

(a) a housing;

(b) a casing mounted in the housing and defining, at least in part, (i) an annular circular piston chamber, (ii) a continuous chamber slot formed in the casing and extending the full interior circumference thereof, and (iii) a combustion chamber;

(c) a shaft mounted in the housing for rotation about its axis and positioned radially inwardly of the annular piston chamber, the shaft having two intersecting passages extending radially therethrough and at right angles;

(d) four pistons movably mounted in the piston chamber for rotation about an axis of rotation which intersects the shaft axis and defines therewith an angle between about 30° and 80°;

(e) a first connecting rod extending through one passage and interconnecting two pistons 180° apart within the piston chamber;

(f) a second connecting rod passing through the second passage and interconnecting the other two pistons 180° apart within the piston chamber, and being pivotable with respect to said first connecting rod within the passages; and (g) ignition means mounted in the combustion chamber whereby ignition drives a piston within the piston chamber which in turn causes the shaft to rotate.

2. The internal combustion rotary engine of claim 1 wherein the axes of rotation of the pistons and the shaft define a plane which passes within 5° of the combustion chamber as measured by the piston axis of rotation and wherein the connecting rods are perpendicular to the piston axis of rotation.

3. The internal combustion engine of claim 1 wherein the intersection of the piston axis of rotation and the shaft axis is at the geometric center of the connecting rods.

4. The internal combustion engine of claim 1 wherein the angle of axes intersection is between 40 and 70 degrees.

5. The internal combustion engine of claim 4 wherein the angle of axes intersection is between 45 and 60 degrees.

6. A rotary engine comprising (a) a housing;

(b) a chamber casing defining a toroidal piston chamber, inlet and outlet ports, a combustion chamber, and an inwardly opening continuous chamber slot;

(c) four pistons mounted in said piston chamber for movement therein about an axis of rotation;

(d) a shaft mounted for rotation in the housing, said shaft axis and piston axis of rotation being in the same plane and intersecting in an angle between 30 and 80; said plane intersecting the combustion chamber and said shaft having two longitudinally extending passages extending diametrically therethrough and being disposed at right angle to one another;

(e) a first connecting rod extending through one of said passages and including connector means extending through the chamber slot for interconnecting two of said pistons on opposite ends of said first rod, said connecting rod being engageable with the shaft for transmitting force thereto;

(f) a second connecting rod extending through the other of said passages and including connector means extending through the chamber slot for interconnecting the other two of said pistons at opposite ends of said second rod said second connecting rod being engageable with the shaft for transmitting force thereto, said first and second rods being angularly movable relative to one another;

(g) ignition means mounted in the combustion chamber of the housing whereby ignition drives a piston through a power stroke within the piston chamber and its paired piston through a suction and compression stroke within the piston chamber.

7. The engine of claim 6 wherein the first and second connecting rods are pivotally interconnected at the intersection of said passages.

8. The engine of claim 6 wherein the connector means includes pivotal means permitting relative angular movement of the connector means about the longitudinal axis of its associated connector rod.

9. A rotary engine comprising (a) a housing;

(b) a chamber casing defining an annular continuous piston chamber, said casing having an interior chamber slot formed therein and defining an inlet opening for fuel and an adjacent outlet opening for exhaust;

(c) a shaft mounted in said housing for rotation therein, said shaft having first and second longitudinal passages forming right angles in the shaft;

(d) a first connecting means extending through the first passage shaft and the chamber slot;

(e) a first pair of pistons secured to opposite ends of the first connecting means and mounted in the piston chamber for rotary movement therein about an axis of rotation;

(f) a second connecting means extending through the second passage of the shaft, through a central portion of the first connecting means; and through the chamber slot;

(g) a second pair of pistons secured to opposite ends of the second connecting means and mounted in the piston chamber for rotary movement therein about said axis of rotation, said first and second connecting means being in contact with the shaft for transmitting force therebetween, but being pivotable with respect to one another to permit relative movement of the first and second pair of pistons within the piston chamber, each piston pair being movable through a compression stroke and a power stroke;

(h) a combustion chamber formed in the housing approximately opposite the inlet and outlet openings and being in fluid communication with said piston chamber;

(i) ignition means mounted in the combustion chamber;

the shaft axis intersecting the axis of rotation at an angle between 30° and 80° and defining a plane while passes within 5° of the combustion chamber.

10. The engine of claim 9 wherein the interconnected pistons are positioned 180° apart within the piston chamber and wherein ignition drives one piston through a power stroke which in turn moves the other piston of the pair through a compression stroke.

* * * * *